US007296870B2

(12) United States Patent
Tyson et al.

(10) Patent No.: US 7,296,870 B2
(45) Date of Patent: Nov. 20, 2007

(54) MANAGING CONSUMABLE WEAR IN PRINTERS

(76) Inventors: Ben B. Tyson, 1661 E. Stonybrook Ct., Eagle, ID (US) 83616; David E. Smith, 1211 S. Plaza Rd., Emmett, ID (US) 83617; Steven R. Folkner, 2361 Ridgeview Way, Boise, ID (US) 83712; Theresa A. Burkes, 3100 San Ramon Drive, Meridian, ID (US) 83642

( * ) Notice: Subject to any disclaimer, the term of this patent is extended or adjusted under 35 U.S.C. 154(b) by 920 days.

(21) Appl. No.: 10/272,074

(22) Filed: Oct. 16, 2002

(65) Prior Publication Data

US 2004/0075855 A1 Apr. 22, 2004

(51) Int. Cl.
*B41J 29/393* (2006.01)

(52) U.S. Cl. ..... 347/19; 347/9; 347/5

(58) Field of Classification Search ..... 347/2, 347/19, 9, 5, 23; 355/209; 399/24, 66
See application file for complete search history.

(56) References Cited

U.S. PATENT DOCUMENTS

| | | | | |
|---|---|---|---|---|
| 5,101,233 | A * | 3/1992 | Ito et al. | 399/24 |
| 5,313,312 | A | 5/1994 | Yamada | 358/505 |
| 5,896,207 | A | 4/1999 | Tomida | 358/537 |
| 6,029,023 | A | 2/2000 | Munemori et al. | 399/66 |
| 6,363,231 | B1 | 3/2002 | Manzer et al. | 399/82 |
| 6,408,145 | B1 | 6/2002 | Ohki | 399/50 |

* cited by examiner

*Primary Examiner*—Lam Son Nguyen
(74) *Attorney, Agent, or Firm*—Lee & Hayes, PLLC

(57) ABSTRACT

A printer or other color output device is configured to manage consumable wear. A wear level and a consumable use level of a color cartridge are evaluated. A color cartridge failure mechanism is projected to be either color cartridge wear-out or consumable exhaustion. Where color cartridge wear-out is projected, selection is made between faster printing and a reduced risk of color cartridge wear-out.

7 Claims, 6 Drawing Sheets

MANAGING CONSUMABLE WEAR IN PRINTERS

TECHNICAL FIELD

This disclosure relates to managing consumable wear in printers.

BACKGROUND

Many currently available color laser printers have two modes: a color mode and a monochrome mode. In the color mode, a color cartridge is engaged and is therefore available for use along with a monochrome cartridge. In the monochrome mode color components are disengaged to save wear. Several seconds are typically required to complete a switch between color and monochrome modes. During this switch, some additional wear and tear on the color cartridge and other components may result.

Where the usage rate of the color cartridge is sufficiently high, consumables within the cartridge are depleted within the life cycle of the cartridge. Alternatively, where the percentage of monochrome pages printed is high enough, and the usage rate of the color cartridge is below a threshold level, wear and tear on mechanically active components within the cartridge, as well as wear and tear on consumables such as toner within the cartridge, will degrade the print quality of the cartridge before exhaustion of the supply of consumables within the cartridge. In other words, where pages printed entirely in monochrome exceed a threshold value, and color use is minimal, an engaged color cartridge will wear out before it is depleted. Accordingly, the user will not receive the rated page output for the cartridge.

SUMMARY

In one embodiment of the invention, a printer or other color output device is configured to manage consumable wear. A wear level and a consumable use level of a color cartridge are evaluated. A color cartridge failure mechanism is projected to be either color cartridge wear-out or consumable exhaustion. Where color cartridge wear-out is projected, selection is made between faster printing and a reduced risk of color cartridge wear-out.

BRIEF DESCRIPTION OF THE DRAWINGS

The same reference numbers are used throughout the drawings to reference like features and components.

DETAILED DESCRIPTION

Figure 1:
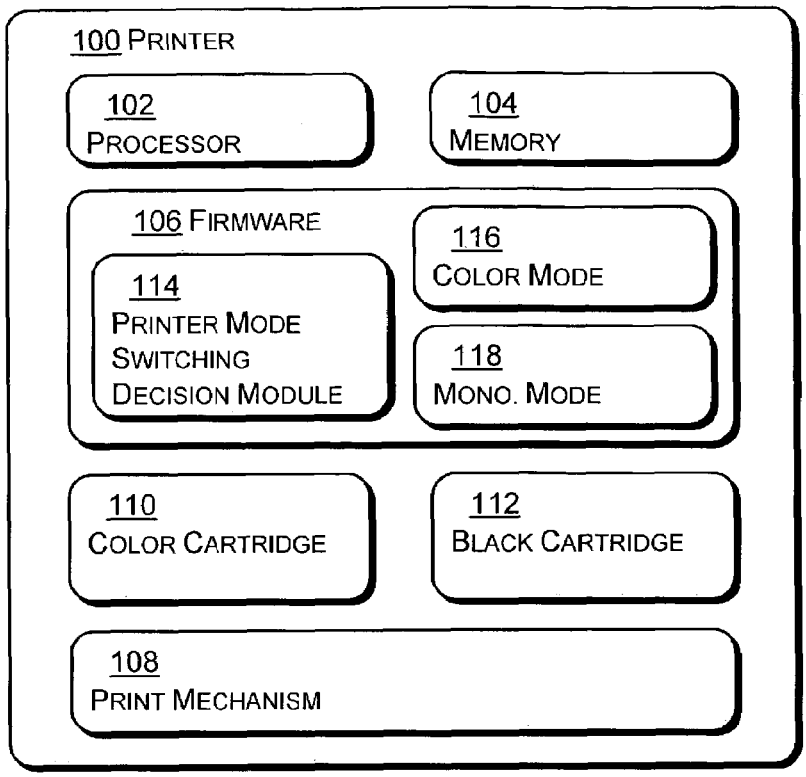
FIG. 1 is a block diagram illustrating a printer configured to switch between color and monochrome print modes.

FIG. 1 shows a block diagram representing an exemplary printer 100, such as a color copier, multifunctional peripheral or other color output device, configured to switch between color and monochrome modes to reduce color cartridge wear-out prior to color cartridge consumables exhaustion. In an exemplary application, a color cartridge is engaged during color mode, and disengaged during monochrome mode. In the application, color cartridge wear-out and color cartridge consumables exhaustion are failure mechanisms by which color cartridge failure is experienced. The exemplary printer 100 is configured with a processor 102, memory 104 and firmware 106. A print mechanism 108 is adapted for operation with a color cartridge 110 and a black or monochrome cartridge 112.

The firmware 106 includes a printer mode switching decision module 114, which is configured to examine risk factors to a color cartridge 110 and to switch between color and monochrome modes 116, 118 to reduce color cartridge wear-out prior to color cartridge consumable exhaustion when color cartridge wear-out is predicted. Thus, in some circumstances, the printer mode switching decision module 114 may determine that the color cartridge 110 will wear out prior to using all consumables, e.g. color toner. In such conditions, the module 114 may switch between software to control a color mode 116 and a monochrome mode 118 to reduce wear to the color cartridge 110, and thereby extend the life span of the color cartridge until the point of consumables exhaustion (e.g. until the toner is exhausted).

Figure 2:
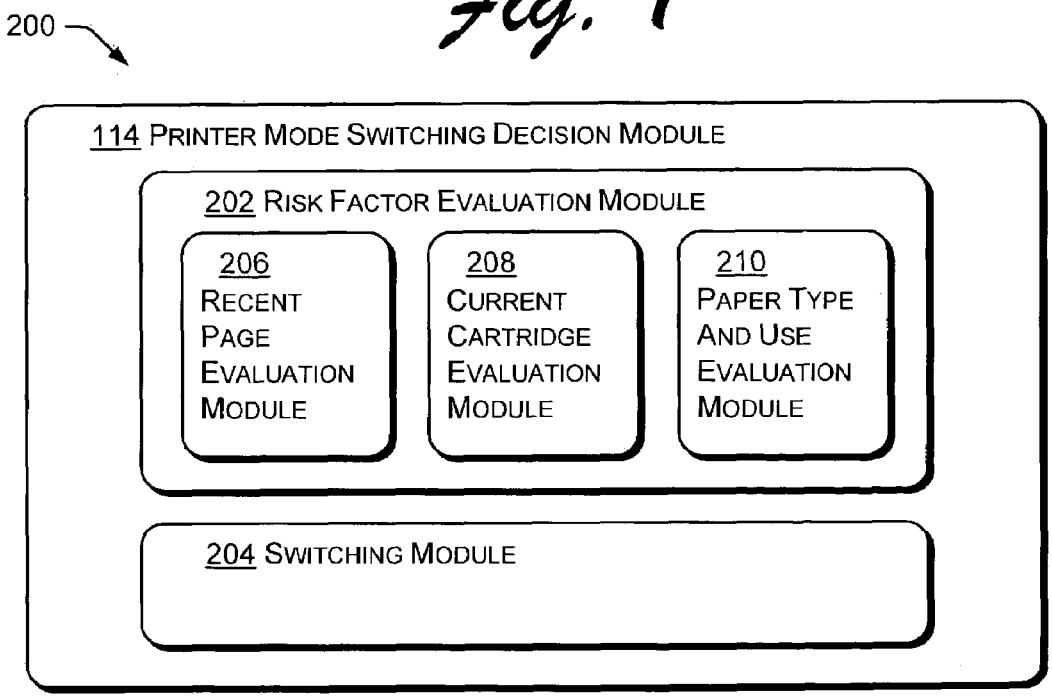
FIG. 2 is a block diagram illustrating a first version of a printer mode switching module contained within firmware within the printer of FIG. 1.

FIG. 2 shows a first exemplary version 200 of the printer mode switching decision module 114. In the version seen in FIG. 2, a risk factor evaluation module 202 is configured to evaluate the risk to the color cartridge 110 that wear-out will occur prior to consumables exhaustion. Where risk factors indicate the benefit of doing so, a switching module 204 is configured to switch between color and monochrome modes 116, 118. As seen above, when color mode 116 is engaged, the printer is able to print in color, and moving parts within the color cartridge 110 are engaged, thereby increasing a wear rate on both the mechanical parts of the cartridge, as well as a wear rate on the consumables, such as toner, contained within the cartridge.

Continuing to refer to FIG. 2, a recent page risk factor evaluation module 206 is configured to establish a printing history based on an arbitrary quantity of recent pages printed, such as, for example, the most recent 2000 pages printed. The printing history may include a number of elements, including but not limited to the following factors: a percentage of color pages within the total number of pages printed; a percentage of toner coverage for each color; number of pages per print job; number of pages by paper size; and, number of pages per job by paper size.

A current cartridge evaluation module 208 records information similar to that recorded by the recent page evaluation module 206, but which is based on the number of pages which were printed by the current color cartridge. Therefore, the current cartridge evaluation module 208 includes information related to the degree to which the color cartridge 110 is worn out, and also the degree to which the consumables are exhausted.

A paper type and use evaluation module 210 is configured to record the types and sizes of paper used in an arbitrary number of pages printed, such as the most recent 2000 pages printed. Because different paper types and paper sizes may be statistically correlated with color output or monochrome output, the paper type and use evaluation module 210 can additionally be configured to notify the switching module 204 to switch modes based on information contained within a print job indicating use of a particular paper type or size.

Figure 3:
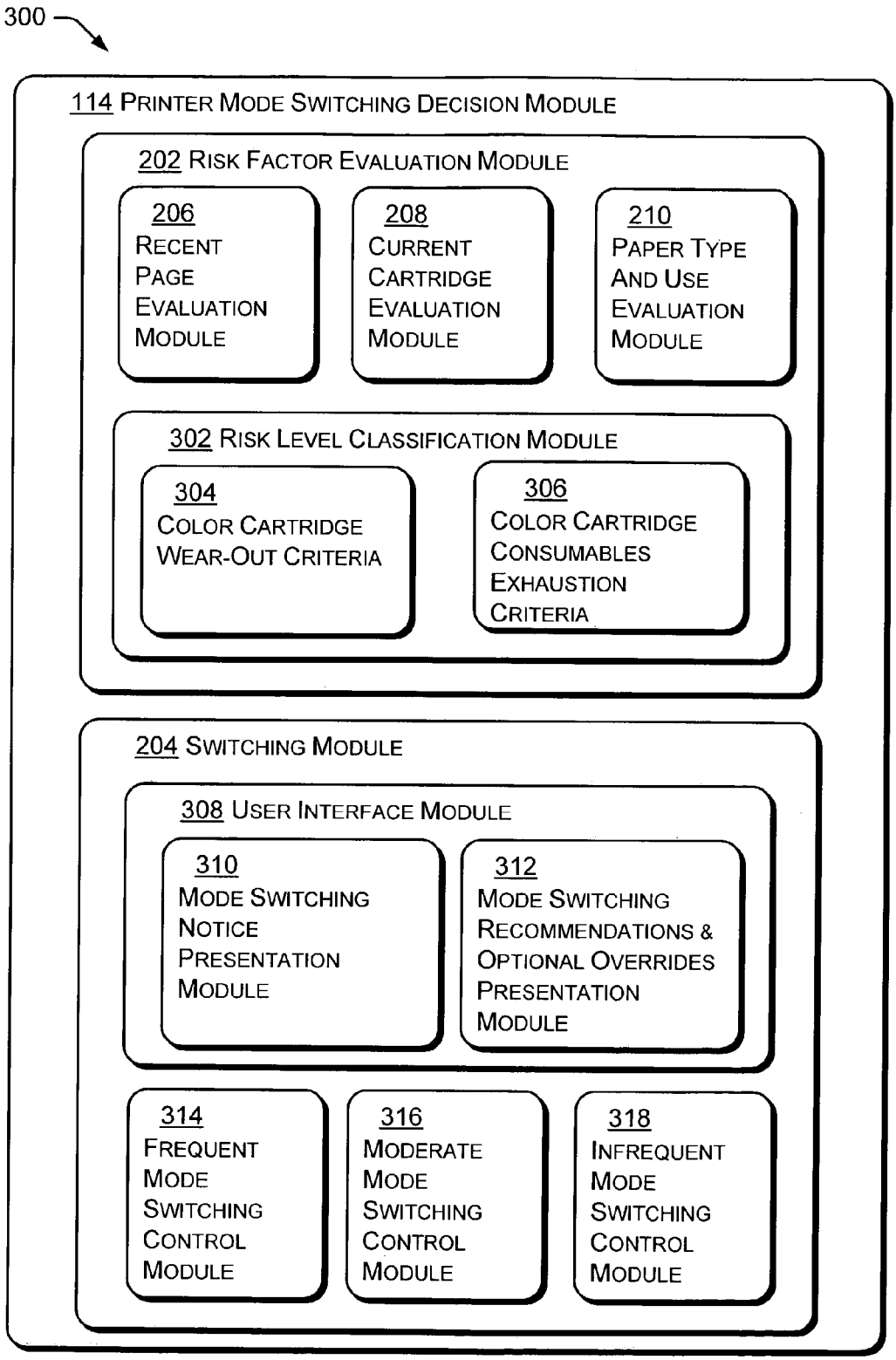
FIG. 3 is a block diagram illustrating a second version of a printer mode switching module contained within firmware within the printer of FIG. 1.

FIG. 3 shows a second exemplary version 300 of the printer mode switching decision module 114. In the version seen in FIG. 3, the risk factor evaluation module 202 additionally includes a risk level classification module 302. Information on the risk factors facing the color cartridge 110 are evaluated by the risk factor evaluation module 202, allowing the risk level classification module 302 to classify data related to the color cartridge 110 as being either consistent with a color cartridge wear-out criteria 304 or consistent with a color cartridge consumables exhaustion criteria 306. Note that it is desirable for data associated with the color cartridge to be consistent with the color cartridge consumables exhaustion criteria 306, since this means that the user will have obtained all of the benefit of the consumables, such as toner. The color cartridge wear-out criteria 304 and the color cartridge consumables exhaustion criteria 306 include information such as the number of sheets printed, the number of sheets printed in color and the percentage of toner coverage for each color which is consistent with each criteria. The information contained within the color cartridge wear-out criteria 304 module and color cartridge consumables exhaustion criteria 306 module are specific to each color cartridge 110. Additionally, the printer mode switching module 114 may be adapted for use in a number of different printers. Accordingly, each module 304, 306 may contain information related to a plurality of color cartridges, or may be configured to be updated to include the color cartridge currently in use.

The switching module 204 of the second exemplary version 300 includes a user interface 308, which may be used to announce to the user that mode switching is taking place, and which may additionally present the user with an opportunity to override the mode switching. In particular, a mode switching notice presentation module 310 informs the user that mode switching is taking place, and may include information to inform the user of the benefits and drawbacks of mode switching. For example, the user interface 308 may present the user with the choice of either minimizing the chance of color cartridge wear-out or obtaining faster printing performance. The mode switching notice presentation module 310 may operate on a workstation operated by the user, using such interface tools as dialog boxes, or on a control panel mounted on the printer or color copier. Alternatively, a mode switching recommendations and optional overrides presentation module 312 may present the user with a dialog box on a workstation or an indicator on a printer control panel containing recommendations as to whether mode switching should be performed, and allow the user to decide.

The switching module 204 may additionally contain frequent, moderate and infrequent mode switching control modules 314, 316, 318, which perform mode switching at different rates and under different circumstances. For example, where the use history of the color cartridge 110 indicates that the cartridge is within the color cartridge wear-out criteria 304, the frequent switching control module 314 is used. When the use history of the color cartridge 110 indicates that the cartridge is within the color cartridge consumables exhaustion criteria 306 the infrequent mode switching control module 318 is used. When the use history of the color cartridge 110 does not clearly indicate whether consumables will be exhausted prior to wear-out, the moderate mode switching control module 316 is used.

Figure 4:
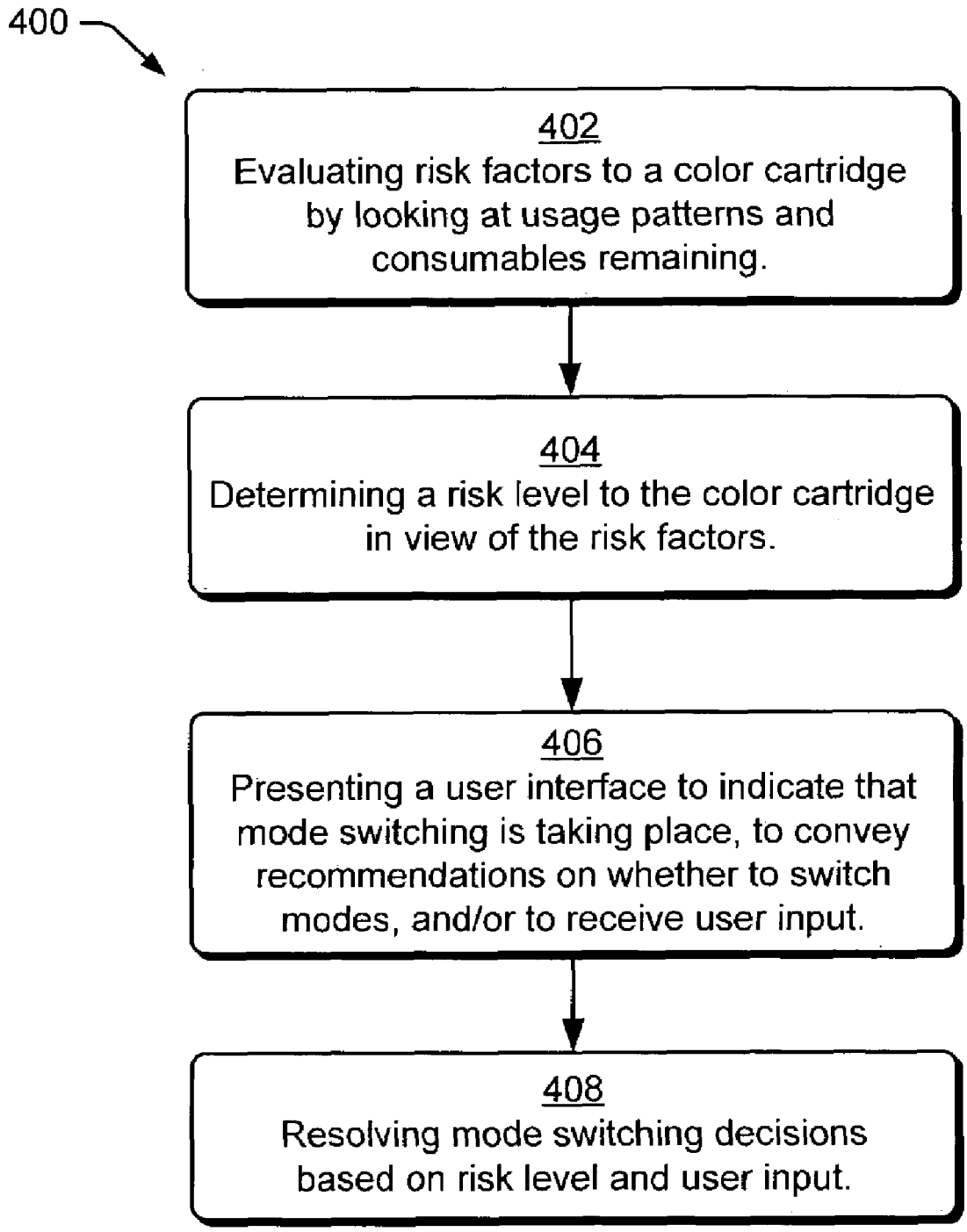
FIG. 4 is a flow diagram that describes a first method to switch between color and monochrome print modes.

The flow chart of FIG. 4 illustrates an exemplary implementation of a method 400 to resolve mode switching decisions based on risk level and user input. The elements of the method may be performed by any desired means, such as by the execution of processor-readable instructions defined on a processor-readable media, such as a disk, a ROM or other memory device or by operation of an application specific integrated circuit (ASIC) or other hardware device. In one embodiment, the ROM may contain firmware implementing the printer mode switching decision module 114 of FIGS. 1 and 2 according to an exemplary method as seen in the flow chart of FIG. 4. In an alternative embodiment, an ASIC may contain logic implementing the printer mode switching decision module 114 according to an exemplary method as seen in the flow chart of FIG. 4. The actions described in the blocks of FIG. 4 may be performed in parallel with actions described in other blocks, may occur in an alternate order, or may be distributed in a manner which associates actions with more than one other block.

At block 402, risk factors to a color cartridge 110 are evaluated by looking at usage patterns and consumables remaining. The risk factors involve use patterns that could result in the color cartridge 110 having a failure mechanism involving wear-out, rather than consumables exhaustion. Where the color cartridge 110 wears out prior to exhausting all consumables, the user fails to receive the full benefit of the color cartridge 110. In one implementation, the risk factor evaluation module 202 evaluates the risks to the color cartridge 110 of wear-out before consumable exhaustion.

At block 404, a risk level to the color cartridge is determined, in view of the risk factors evaluated. In one implementation, the risk level classification module 302 classifies the risk to the color cartridge 110 of wear-out before consumable exhaustion. The classification may be made by comparing the use history of the color cartridge 110 to the color cartridge wear-out criteria 304 and to the color cartridge consumables exhaustion criteria 306. For any given color cartridge 110, the criteria 304, 306 may be consulted to facilitate determination of the risk to the color cartridge 110.

At block 406, a user interface may optionally be presented to the user to indicate that mode switching is taking place. The user interface may be managed by a user interface module 308 or similar structure. The notice to the user may be made by the use of a dialog box or other means suggested by the operating system involved.

Where the user interface module 308 is configured to give the user greater influence over the mode switching process, the user interface may convey recommendations on whether to switch modes. The user may then elect to allow the mode switching or prevent it.

At block 408, the mode switching decisions are resolved based on the determination of the risk level and/or any available user input. In one implementation, the mode switching module 204 resolves mode switching decisions using software, firmware or hardware-based logic. For example, where the risk level to the color cartridge 110 was determined to be consistent with the color cartridge wear-out criteria 304, the mode may be switched from color to monochrome if the print job is monochrome to prevent additional wear on the color cartridge 110. Alternately, where the risk level to the color cartridge 110 was determined to be low, because the expected fate of the color cartridge 110 was predicted to be consistent with the consumables exhaustion criteria 306, the color cartridge 110 may be left to operate in color mode, even when the print job is monochrome, since this saves the user from waiting for the mode change. Additionally, where exhaustion of the consumables (e.g. toner) is predicted to precede wear-out, there is little benefit from sparing the color cartridge 110 the additional wear it would experience in printing a monochrome print job while in color mode.

Figure 5:
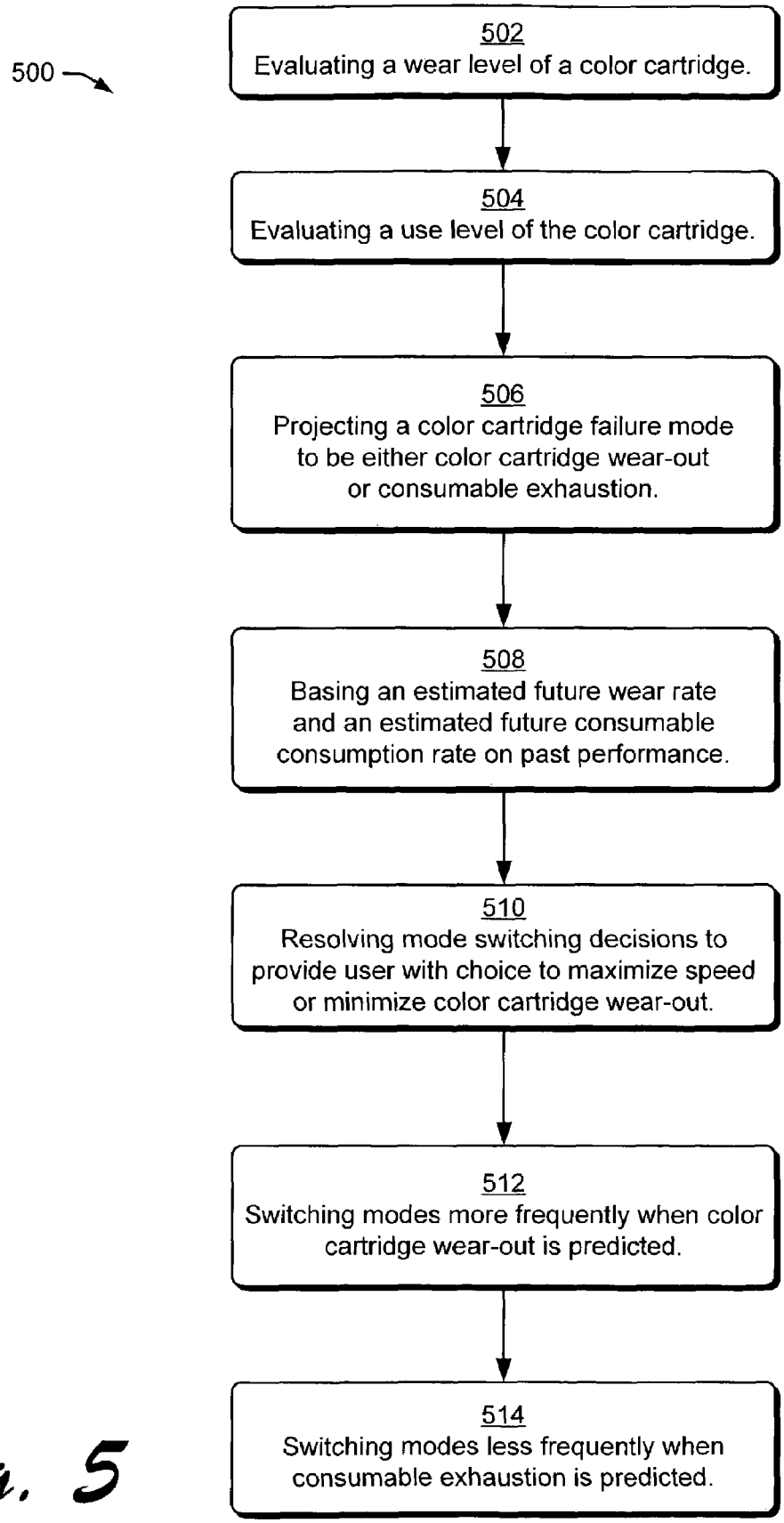
FIG. 5 is a flow diagram that describes a second method to switch between color and monochrome print modes.

The flow chart of FIG. 5 illustrates a further exemplary implementation, wherein a method 500 is employed to resolve mode switching decisions based on risk level. The elements of the method may be performed by any desired means, such as by the execution of processor-readable instructions defined on a processor-readable media, such as a disk, a ROM or other memory device or by operation of an application specific integrated circuit (ASIC) or other hardware device. In one embodiment, the ROM may contain firmware implementing the printer mode switching decision module 114 of FIGS. 1 and 2 according to an exemplary method as seen in the flow chart of FIG. 5. In an alternative embodiment, an ASIC may contain logic which implements the printer mode switching decision module 114 according to an exemplary method as seen in the flow chart of FIG. 5. Also, actions described in any block may be performed in parallel with actions described in other blocks, may occur in an alternate order, or may be distributed in a manner which associates actions with more than one other block.

At block 502, a current wear level of the color cartridge 110 is evaluated. For example, the current cartridge evaluation module 208 may be used to determine the current wear level, which is typically estimated by a count of pages printed in color mode and monochrome pages printed while the printer was in color mode.

At block 504, a consumable use level of the color cartridge is also measured. The consumable use level is typically estimated by a count of pages printed in color mode, modified by average toner coverage levels for each color. For example, this functionality may be performed by the current cartridge evaluation module 208 or similar structure implemented in software, firmware or hardware.

At block 506, a color cartridge failure mechanism is projected to be either color cartridge wear-out or consumable exhaustion. This projection may be made by the risk level classification module 302 or similar structure implemented in software, firmware or hardware. At block 508, in projecting the color cartridge failure mechanism, an estimated future wear rate and an estimated consumable consumption rate are based on past performance. The past performance may be monitored by a structure such as by the recent page evaluation module 206 or the current cartridge evaluation module 208 or similar structure implemented in software, firmware or hardware.

At block 510, mode switching decisions are resolved to prevent color cartridge wear-out using the projected color cartridge failure mechanism, unless such decisions are specifically overridden by the user's input. Switching decisions may be made by a switching module 204, or similar structure implemented in software, firmware or hardware. For example, where color cartridge wear-out is projected, the user could be allowed to select between the advantages of either faster printing performance or reducing the risk of color cartridge wear-out. Thus, the user could elect to prevent mode switching to result in faster printing performance; alternatively, the user could elected to allow mode switching where that would result in reduced chance of color cartridge wear-out. Alternatively, where desired, the mode switching decision could be made in an automated manner consistent with a desired goal. In particular, at block 512 modes are switched more frequently, such as by a frequent mode switching module 314, when color cartridge wear-out is predicted. This results in more monochrome print jobs being printed in monochrome mode, which protects the color cartridge 110 from wear during these print jobs. Additionally, at block 514, modes are switched less frequently, or not at all, when consumable exhaustion is predicted, such as by an infrequent mode switching module 318. This results in more monochrome print jobs being printed in color mode, since the wear on the color cartridge 110 is not expected to prevent full usage of the consumables.

Figure 6:
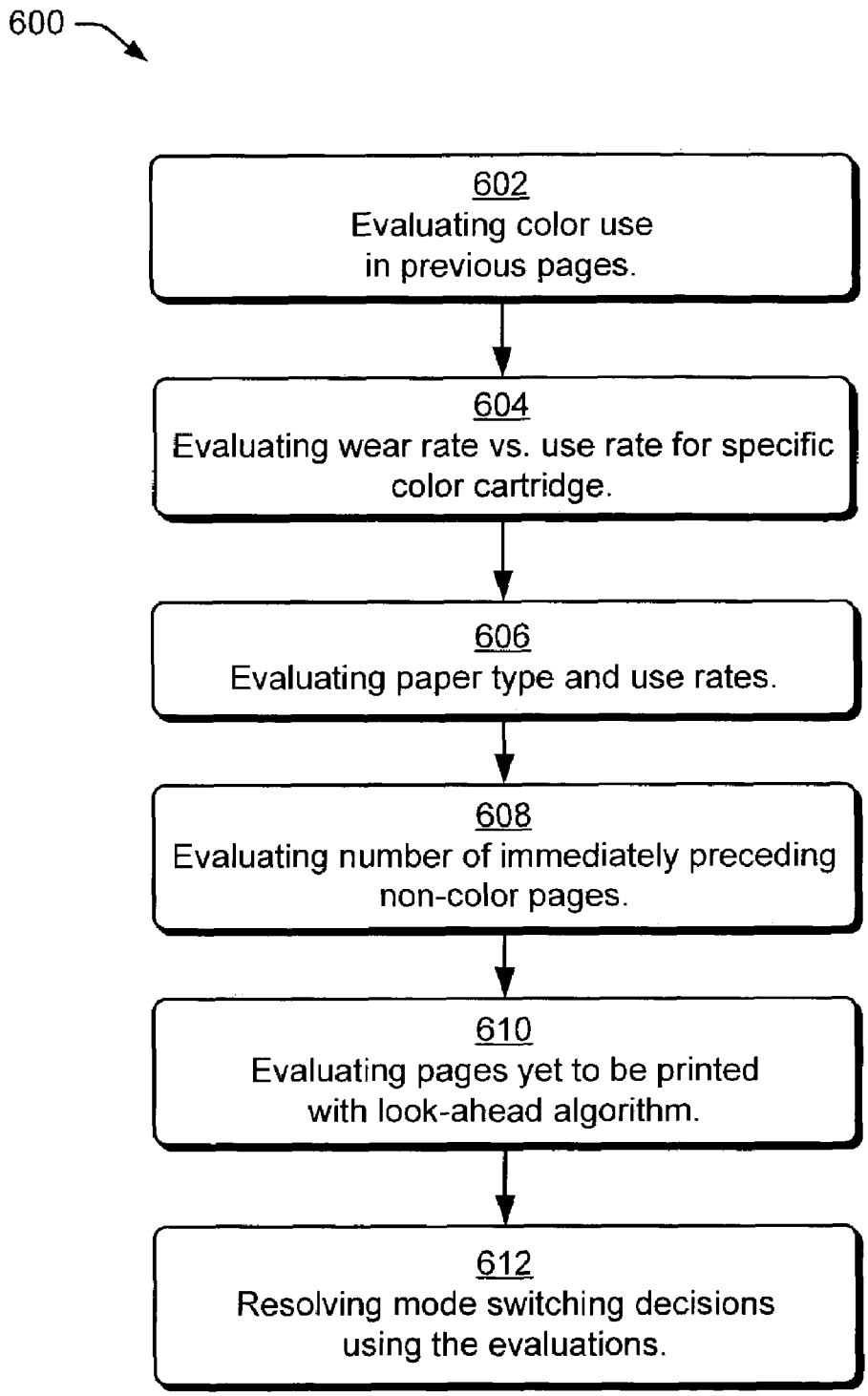
FIG. 6 is a flow diagram that describes a third method to switch between color and monochrome print modes.

The flow chart of FIG. 6 illustrates a further exemplary implementation, wherein a method 600 is employed to resolve mode switching decisions. The elements of the method may be performed by any desired means, such as by the execution of processor-readable instructions defined on a processor-readable media, such as a disk, a ROM or other memory device or by operation of an application specific integrated circuit (ASIC) or other hardware device. In one embodiment, the ROM may contain firmware implementing the printer mode switching decision module 114 of FIGS. 1 and 2, portions of which are implemented according to an exemplary method as seen in the flow chart of FIG. 6. In an alternative embodiment, an ASIC may contain logic which supports the printer mode switching decision module 114, portions of which are implemented according to an exemplary method as seen in the flow chart of FIG. 6. Also, actions described in any block may be performed in parallel with actions described in other blocks, may occur in an alternate order, or may be distributed in a manner which associates actions with more than one other block.

At block 602, color use in previous pages is evaluated. In one example, the previous 2000 pages are examined for number of pages with color use and average toner coverage rates for each color by the recent page evaluation module 206 or similar structure implemented in software, firmware or hardware.

At block 604, a wear rate verses a use rate is evaluated for a specific color cartridge 110 installed in the printer 100 by the current cartridge evaluation module 208 or similar structure implemented in software, firmware or hardware. Thus, only a number of past pages equal to the number of pages printed by the current color cartridge 110 are evaluated. Accordingly, the current status of the color cartridge 110 is known.

At block 606, paper type and usage rates are examined, typically for the previous 2000 (or other desired quantity) pages. Such an examination may be made by the paper type and use evaluation module 210 or similar structure implemented in software, firmware or hardware. Because certain types of paper are strongly associated with either color or monochrome print jobs, monitoring the usage rates of different types of paper can be an indicator of the activity of the color cartridge 110.

At block 608, in some applications, the recent page evaluation module 206 or similar module may additionally evaluate the number of immediately preceding monochrome pages. Where a number of monochrome pages have been printed, the likelihood that the next page to be printed will be monochrome is increased, and this factor may be evaluated.

At block 610, pages yet to be printed are evaluated, to the extent possible, to determine if they are color or monochrome. In some cases, several pages are buffered within a printer. In this case, a look-ahead algorithm may be implemented within the risk factor evaluation module 202 or other convenient location and used to examine the buffered pages for determination if the content is color or monochrome. Alternatively, in some applications the header accompanying a print job will identify the print job as either containing or not containing color content.

At block 612, mode switching decisions may be made by the printer mode switching decision module 114 using the evaluations of blocks 602 through 610. The weight given to any evaluation may be varied according to the application. Mode switching will be performed in a manner consistent with reducing wear-out of the color cartridge 110, except as directed by the user.

Figure 7:
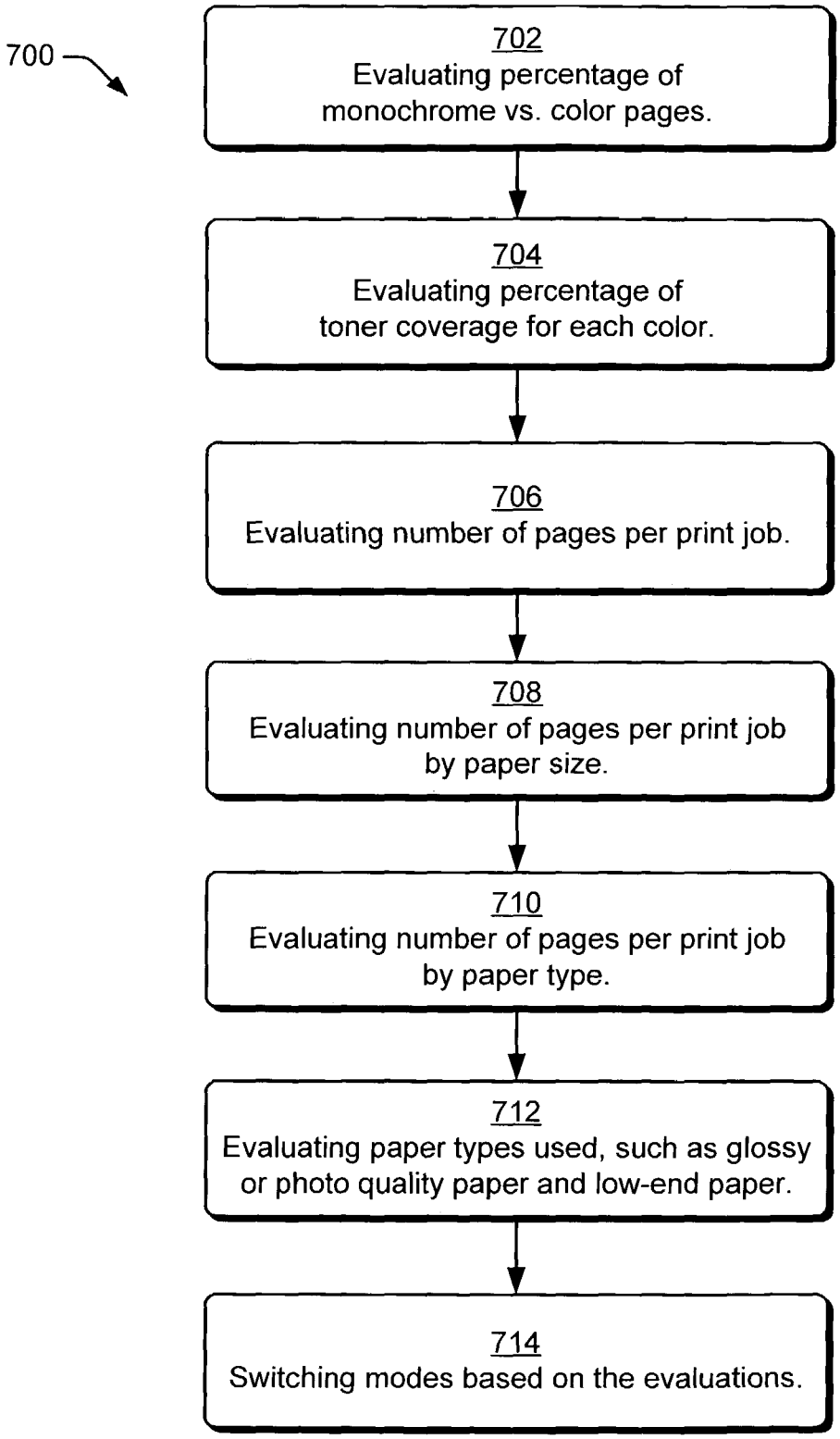
FIG. 7 is a flow diagram that describes a fourth method to switch between color and monochrome print modes.

The flow chart of FIG. 7 illustrates a further exemplary implementation, wherein a method 700 is employed to resolve mode switching decisions. The elements of the method may be performed by any desired means, such as by the execution of processor-readable instructions defined on a processor-readable media, such as a disk, a ROM or other memory device or by operation of an application specific integrated circuit (ASIC) or other hardware device. In one embodiment, the ROM may contain firmware implementing the printer mode switching decision module 114 of FIGS. 1 and 2, portions of which are implemented according to an exemplary method as seen in the flow chart of FIG. 7. In an alternative embodiment, an ASIC may contain logic which supports the printer mode switching decision module 114 of FIGS. 1 and 2, portions of which are implemented according to an exemplary method as seen in the flow chart of FIG. 7. Also, actions described in any block may be performed in parallel with actions described in other blocks, may occur in an alternate order, or may be distributed in a manner which associates actions with more than one other block. Blocks 702-712 represent actions which may be supported by the risk factor evaluation module 202, while the switching decisions of block 714 may be performed by the switching module 204.

At block 702, the percentage of color vs. monochrome pages printed over an historical period, such as the previous 2000 pages, is evaluated. Where desired, the historical period may be adjusted to coincide with the installation of the current color cartridge 110.

At block 704, the percentage of toner coverage for each color is evaluated. In this manner, the percentage of color pages previously found can be weighted, to determine their significance.

At block 706, the number of pages per print job is evaluated over an historical period, such as 2000 pages. Similarly, at block 708, the number of pages per print job is evaluated by paper size. At block 710 the number of pages per print job is evaluated by paper type. At block 712, the paper type used, such as glossy, photo quality or low-end paper is evaluated.

At block 714, the printer switches between color and monochrome mode based on the evaluations made in blocks 702 through 710.

Although the disclosure has been described in language specific to structural features and/or methodological steps, it is to be understood that the appended claims are not limited to the specific features or steps described. Rather, the specific features and steps are exemplary forms of implementing this disclosure. For example, while much of the disclosure has been directed to an exemplary implementation with a printer, it is clear that a color copier, multifunctional peripheral or other color output device could alternatively be substituted. Accordingly, any and all references to a printer in the disclosure or claims include alternative color output devices.

Additionally, while one or more methods have been disclosed by means of flow charts and text associated with the blocks, it is to be understood that the blocks do not necessarily have to be performed in the order in which they were presented, and that an alternative order may result in similar advantages.

The invention claimed is:

1. A processor-readable medium comprising processor-executable instructions for managing consumable wear in a printer, the processor-executable instructions comprising instructions for:

evaluating a wear level and a consumable use level of a color cartridge;

predicting a color cartridge failure mechanism, based on the wear level and the consumable use level, to be either color cartridge wear-out or consumable exhaustion; and based on the prediction, selecting between faster printing and reduced risk of color cartridge wear-out, wherein the selecting comprises:

switching between color and monochrome modes more frequently when color cartridge wear-out is predicted; and switching between color and monochrome modes less frequently when consumable exhaustion is predicted.

2. A processor-readable medium as recited in claim 1, comprising further instructions for:

basing the predicting on an estimated future wear rate based on past performance and an estimated future consumable consumption rate based on past performance.

3. A printer, comprising:

means for tracking a wear level of a color cartridge based on activity in color mode;

means for tracking a consumable use level of the color cartridge based on color consumables expended;

projecting a color cartridge failure mechanism to be either color cartridge wear-out or consumable exhaustion based on the wear level and the consumable use level; and means for switching between color mode and monochrome mode to decrease likelihood of color cartridge wear-out before color consumables are expended, wherein the switching comprises:

switching between color and monochrome modes more frequently when color cartridge wear-out is predicted; and switching between color and monochrome modes less frequently when consumable exhaustion is predicted.

4. The printer as recited in claim 3, additionally comprising:

means for balancing an estimated future wear rate with an estimated consumable consumption rate when projecting the color cartridge failure mechanism.

5. The printer as recited in claim 3, additionally comprising:

means for using history of color verses monochrome pages printed as an input when projecting the color cartridge failure mechanism.

6. A printer, comprising:

means for evaluating a wear level and a consumable use level of a color cartridge to predict a color cartridge failure mechanism; and means for selecting between faster printing and more frequent switching between color mode and monochrome mode in response to the prediction wherein the means for selecting comprises:

means for switching between color and monochrome modes more frequently when color cartridge wear-out is predicted; and means for switching between color and monochrome modes less frequently when consumable exhaustion is predicted.

7. The printer of claim 6, wherein the means for predicting the color cartridge failure mechanism is based on an estimated future wear rate based on past performance and is based on an estimated future consumable consumption rate based on past performance.

* * * * *

UNITED STATES PATENT AND TRADEMARK OFFICE

CERTIFICATE OF CORRECTION

PATENT NO. : 7,296,870 B2
APPLICATION NO. : 10/272074
DATED : November 20, 2007
INVENTOR(S) : Ben B. Tyson et al.

It is certified that error appears in the above-identified patent and that said Letters Patent is hereby corrected as shown below:

In column 8, line 63, in Claim 6, after "prediction" insert -- , --.

Signed and Sealed this

Nineteenth Day of August, 2008

JON W. DUDAS
*Director of the United States Patent and Trademark Office*